US005252020A

United States Patent [19]

Kinney et al.

[11] Patent Number: 5,252,020

[45] Date of Patent: Oct. 12, 1993

[54] WASTE SEGREGATING COLLECTION APPARATUS

[75] Inventors: Russell C. Kinney; Donald C. Kinney, both of Hartland; Lyle Paullin, Oconomowoc; Richard Paullin, Hartland; Jeffrey W. Parrott, Pewaukee; Donald Smith, Oconomowoc, all of Wis.

[73] Assignee: Expert Disposal Service, Inc., Hartland, Wis.

[21] Appl. No.: 706,921

[22] Filed: May 29, 1991

[51] Int. Cl.[5] ..... B65F 3/02

[52] U.S. Cl. ..... 414/346; 298/8 R; 298/17.7; 298/23 MD; 298/22 R; 414/488; 414/340; 414/343; 414/350; 414/408; 414/409; 220/1.5

[58] Field of Search ..... 414/408, 409, 403, 404, 414/406, 407, 340, 343, 345, 346, 349, 350, 488; 298/8 R, 17.5, 23 MD, 22 R, 17.6, 17.7; 220/1.5

[56] References Cited

U.S. PATENT DOCUMENTS

| | | | |
|---|---|---|---|
| 3,111,346 | 11/1963 | Harbers et al. | 298/8 R |
| 3,679,078 | 7/1972 | Wetzel | 414/346 |
| 3,809,267 | 5/1974 | Knight | 414/346 X |
| 3,921,839 | 11/1975 | Herpich | 414/408 |
| 4,219,298 | 8/1980 | Stragier et al. . | |
| 4,242,953 | 1/1981 | St-Gelais | 298/8 R X |
| 4,310,279 | 1/1982 | Johnston | 414/408 |
| 4,597,710 | 7/1986 | Kovats . | |
| 4,830,436 | 5/1989 | Sockwell et al. . | |
| 4,840,531 | 6/1989 | Dinneen . | |
| 4,906,039 | 3/1990 | Broman . | |
| 4,915,570 | 4/1990 | Rath et al. . | |
| 5,015,142 | 5/1991 | Carson | 414/409 X |

FOREIGN PATENT DOCUMENTS

| | | | |
|---|---|---|---|
| 0405428 | 1/1991 | European Pat. Off. | 414/408 |
| 682876 | 11/1952 | United Kingdom | 414/409 |

OTHER PUBLICATIONS

Cushman Advertisement, 1989.

Holden Industries Advertisement, entitled "Flexi--Dump/Easy Load" Jul.-Aug. 1988.

Bayne Machine Worker Advertisement, entitled "Trimline Premium Lift System", admitted prior art.

Lodal Inc., Advertisement, admitted prior art.

Jakel Advertisement, entitled, "Shovelveyor", admitted prior art.

Cushman Motors Publication—Solid Waste Management-Feb. 1969—p. 9—.

*Primary Examiner*—Frank E. Werner

*Attorney, Agent, or Firm*—Quarles & Brady

[57] ABSTRACT

A collection system of recyclable waste includes one or more central vehicles loaded by one or more satellite vehicles all which segregate recyclable materials from non-recyclable materials. The central vehicles are loaded through openings matched to the bins on the satellite vehicles, the latter which may dump their contents along different axes, permitting the bins to be sized flexibly to the openings of the central vehicle and allowing the waste to be loaded and unloaded with a minimum of labor and with reduced risk of commingling. The axis of dumping of the bins and the placement of the receiving openings of the collecting vehicles allow efficient unloading of the segregated material without interference from traffic or unnecessary manual operation.

8 Claims, 4 Drawing Sheets

FIG. 3
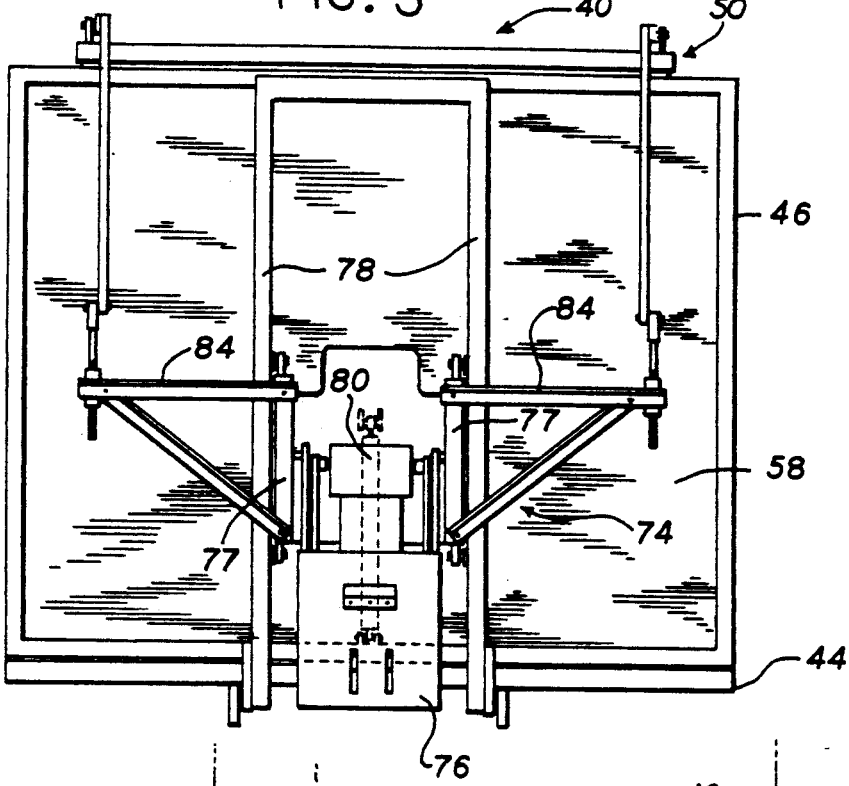
FIG. 4
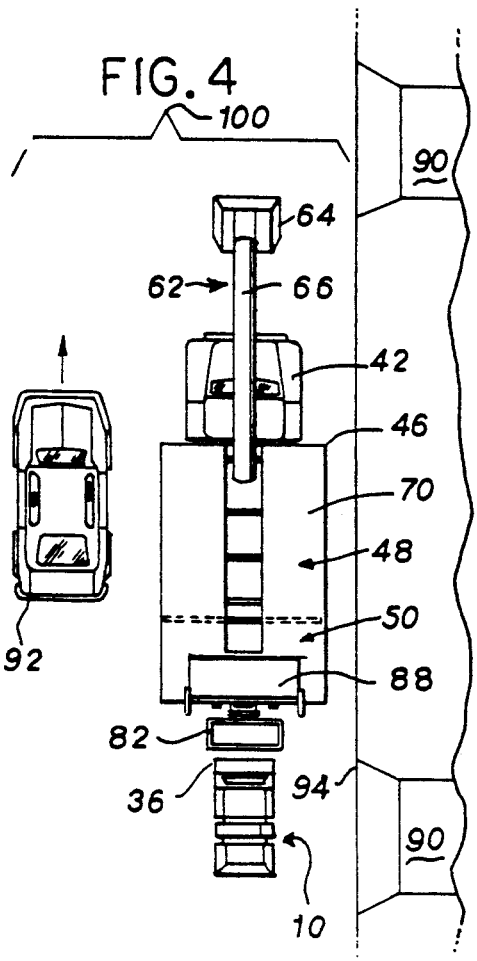
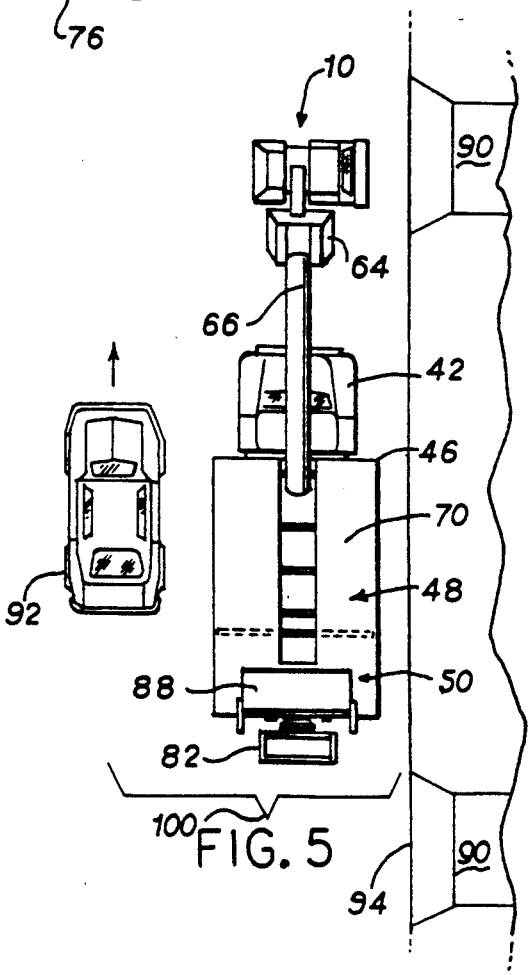
FIG. 5

FIG. 6
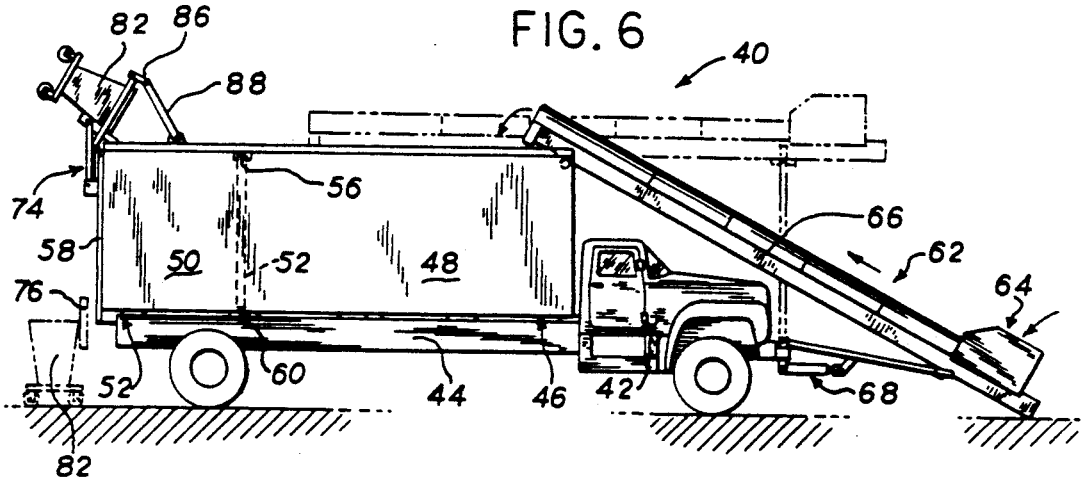
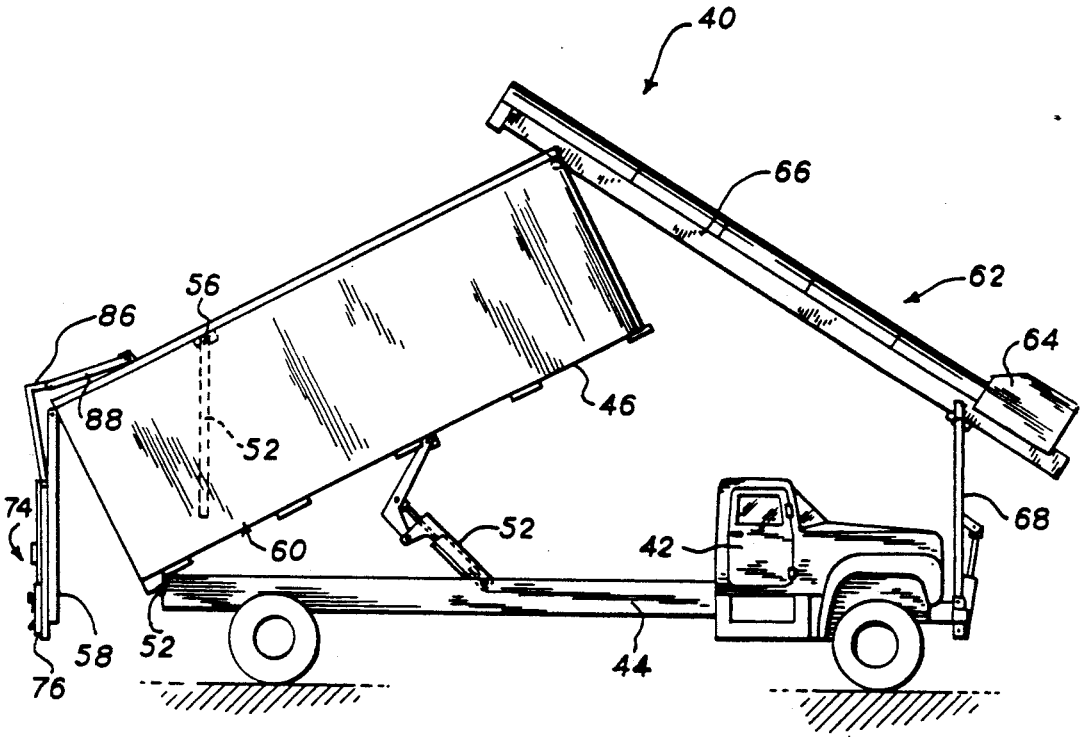
FIG. 7

WASTE SEGREGATING COLLECTION APPARATUS

FIELD OF THE INVENTION

The present invention relates to an apparatus for collecting waste and specifically to an apparatus for efficiently collecting and segregating recyclable waste and non-recyclable waste.

BACKGROUND ART

As the amount of solid waste generated in the United States increases and landfill capacity diminishes, efficient recycling becomes of critical importance. In many communities, recyclable waste amounts to 40% of the total waste collected and yet is not allowed in landfills but must be transported to separate recycling facilities Despite the magnitude of the recycling problem, the economics of waste collection impose severe limits on the additional cost that may be tolerated in dealing with recyclable materials. Waste collection is characterized by frequent collection of small amounts of waste from many decentralized generators, typically homes, for removal to a remote disposal site. A high level of service, as expected by consumers, is possible largely because of the evolutionary optimization of waste handling methods: equipment and labor, over the years, have been carefully matched to task at hand.

The allocation of waste removal equipment has been improved by the use of large trucks having compaction capabilities extending their effective range and capacity between unloadings. Increased range and capacity eliminates unnecessary and costly trips between the customer/generators and the disposal site. The labor needed to collect waste has been minimized by designing these trucks for efficient operation by two or three man teams. Frequently, the trucks will include specialized hoists to lift trash containers into the truck. Such hoists are controlled from curbside, reducing wasted motion in the collection cycle.

A principle additional cost to the recycling of waste is the separation of the waste types. Although various procedures have been proposed for the separation of waste types at the disposal site, currently, the most cost effective separation method is to have recyclable waste separated by the customer/generator and to maintain that separation throughout the waste collection process.

The difficulty of maintaining a number of separated waste streams is monumental. The straightforward approach, of having separate vehicles and collection teams for each waste stream, increases the total cost of waste collection by the number of separate collections. The cost is increased further by the fact that with such separate collections, the average waste volume collected by each collection team is a smaller percentage of the waste generated by each household. Accordingly, the efficiencies of waste collection drop markedly.

SUMMARY OF THE INVENTION

The present invention provides an apparatus and system for collecting multiple, segregated waste types without unduly increasing the amount of labor, time or equipment required. One central vehicle with a partitioned container or several central collection vehicles are loaded from one or more satellite vehicles, the latter having multiple bins to maintain the separation of the waste types. The carts improve the productivity of the loading personnel and allow the central vehicles to be larger than would be possible if such vehicles were to travel directly to the waste collection points through alleyways and the like.

Thus, it is one object of the invention to improve the efficiency of handling multiple segregated waste streams. The increased size of the central collection vehicles allowed by the satellite vehicles improves their effective range of collection even without compaction, such compaction which is rendered difficult by the segregation requirement of the waste streams.

The central collection vehicle and the satellite vehicles are designed to work effectively together. Specifically, a first waste loader communicates with a first volume of the partitioned container of the central collection vehicle through an opening sized to receive the lip of a first bin of the satellite vehicle and a second waste loader communicates with the second volume of a partitioned container of the central collection vehicle through an opening sized to receive the lip of a second bin of the satellite vehicle. The bins are mounted on the satellite vehicle to permit the lips' sizes to be substantially different. In one embodiment, the bins dump along different axes.

It is thus another object of the invention to allow separate waste types to be reliably unloaded without risk of commingling or loss. The different lip sizes reduce the possibility of inadvertent commingling of the waste at unloading to the collection vehicles by providing a physical restraint to the improper unloading of the bins. The bins may be pivoted along different axes to allow the size of each bin and the lip over which the bins dump to be flexibly selected without unduly increasing the size of the satellite vehicle. The larger bin may be conveniently dumped rearward and its lip may extend the full width of the cart, while the smaller bin may have a narrower lip commensurate with its volume. The lip sizes may also be adjusted to reflect the openings of standard central collection vehicles and to prevent spilling or backwash of waste during the dumping process.

In one embodiment, when the bins are in a collection position, they are open at the top and accessible from many angles around the vehicle. Also, the openings of the bins may be adjacent to one another to simplify the loading of many small amounts of different waste types.

It is thus another object of the invention to allow multiple small amounts of separate waste types to be simply loaded into the satellite vehicle, and yet to be easily unloaded in larger amounts to the central collection vehicle.

It is yet another object of the invention to reduce the additional time and labor required to handle segregated waste. The bins on the satellite vehicle may dump toward the rear and toward the curb side of the satellite vehicle. The satellite vehicle may thus unload its separated wastes by backing up to one central vehicle's rear and dumping its rear bin and then proceeding with traffic around that central vehicle to dump its second bin at the front of a second vehicle. Optionally, the satellite vehicle may proceed with traffic to the rear of a second vehicle to empty an optional front bin. The selection of unloading directions permits the unloading to be accomplished with the flow of traffic in an efficient manner.

The foregoing and other objects and advantages of the invention will appear from the following description. In the description, reference is made to the accompanying drawings which form a part hereof, and in which there is shown by way of illustration, a preferred embodiment of the invention. Such embodiment does not necessarily represent the full scope of the invention, however, and reference must be made therefore to the claims herein for interpreting the scope of the invention.

BRIEF DESCRIPTION OF THE DRAWINGS

FIG. 3 is a detailed view of the rear door of the central collection vehicle showing the rear lift in the lowered position;

FIGS. 4 and 5 are plan views of the central collection vehicle being loaded by the satellite vehicle and showing the relative flow of traffic and the placement of the satellite vehicle for the unloading;

FIG. 6 is a side view of the central collection vehicle showing the rear lift in the dumping position, the front conveyor in the loading position and the container in the collection position;

FIG. 7 is a view similar to that of FIG. 6 showing the front conveyor in the transportation position and the container in the dumping position.

DETAILED DESCRIPTION OF THE PREFERRED EMBODIMENT

Figure 2:
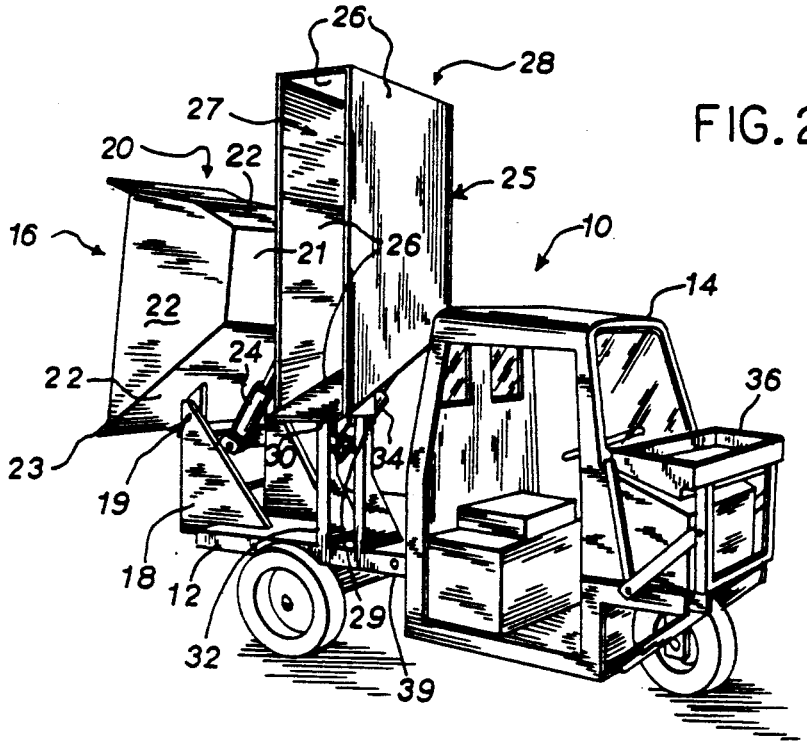
FIG. 2 is a perspective side view of the satellite collection vehicle showing the front and side bins in the dumping positions.

Referring to FIG. 2, a satellite collection vehicle 10 includes generally a driver's compartment 14 mounted at the front and a rear bed 12. The driver's compartment 14 houses a small gasoline engine or the like for propulsion of the satellite vehicle 10 along its longitudinal axis and a steering system, as is well understood in the art. A number of different vehicles suitable for use with the invention are manufactured by Cushman Inc., of Lincoln, Nebr.

A box-like rear bin 20, having a bottom 21 and four upstanding side walls 22, is held by the bed 12 and opens at a face 16 for receiving a first waste type, typically non-recyclable waste. The rear bin 20 is pivotally attached to the bed 12 by a hinge 19 having one hinge side fastened near a lip 23 of the rearmost sidewall 22 and the other hinge side attached to the top of an upstanding hinge support 18. The lower end of the hinge support 18 is affixed to the rear edge of the bed 12.

A hydraulic cylinder 24 extends between the hinge support 18 and a tie point (not shown), attached to the bottom 21 of the rear bin 20 so as to swing the rear bin 20 about the hinge 19 and between a first collection position (not shown in FIG. 2), in which the bottom 21 of the bin 20 is adjacent to the bed 12 and the face 16 opens vertically upward, and a second dumping position (shown in FIG. 2) in which the bottom 21 of the bin 20 swings away from the bed 12 under the influence of the hydraulic cylinder 24, and the upper face 16 opens horizontally rearward so that the contents of the rear bin 20 may be dumped over lip 23.

In the preferred embodiment, lip 23 extends horizontally sixty-six inches so as to be compatible with the seventy-two inch openings of conventional trash-compacting garbage trucks. The eight inch difference allows a margin of four inches on a side to permit the driver some error in aligning the two openings. Proper sizing between the lip 23 and the receiving opening of the truck prevents spilling of waste from the bin 20 and backwash of waste from the receiving truck. It will be understood that other dimensions may be used.

A box-like side bin 28, similar to rear bin 20, and having a bottom 25 and four upstanding side walls 26, is located between the rear bin 20 and the driver's compartment 14 and opens at a face 27 to receive a second waste type, typically recyclable materials having a lower average collection volume than the non-recyclable materials. The side bin 28 is pivotally attached to the bed 12 by a hinge 29, having one hinge side fastened near a lip 30 of the curb side sidewall 26 of side bin 28 and the other hinge side attached to the top of an upstanding hinge support 32 affixed along its lower end to the curb side of the bed 12. A second hydraulic cylinder 34 extends between the hinge support 32 and a tie point (not shown) attached to the bottom 25 of the side bin 28 to swing the side bin 28 between a first collection position (not shown in FIG. 2), in which the bottom 25 of the bin 28 is adjacent to the bed 12 and the face 27 opens vertically upward adjacent to the face 16 of the rear bin 20, when the rear bin 20 is likewise in the collection position, and a second dumping position in which the bottom 25 of the bin 28 swings away from the bed 12 under the influence of the hydraulic cylinder 34, and the face 27 opens horizontally sideways so that the contents may be dumped over lip 30 toward the curb side of the vehicle 10.

It will be understood that the curb side of the vehicle 10 is that side of the vehicle closest to the curb when the vehicle is observing the rules of travel on the roads and that the traffic side is opposite to the curb side. Likewise, the rear and front of the vehicle are those directions corresponding to the vehicle's normal motion.

The rear bin 20 may be constructed of welded 14 gauge sheet steel or of fiberglass according to well known methods.

The lip 30 of the side bin 28 is substantially narrower than the lip 23 of the rear bin 20, commensurate with the smaller volume of side bin 28 and to differentiate its waste type from that held in the rear bin 20, during the unloading process as will be described.

During loading of the satellite vehicle 10, the rear and side bins 20 and 28 will be in the collection position and the bins 20 and 28 may be filled by dropping the waste bundles into the upwardly open faces 16 and 27 of bins 20 and 28 as selected according to a visual determination of waste types or markings on the waste handle. A short screen 34 extends upward from the top of the frontmost sidewall 22 of the rear bin 20 to prevent spillage from one bin to the other, when both are full and in the collection position, but not to impede the convenient loading of the bins 20 and 28 by the driver from a number of angles about the vehicle 10. It must be remembered that each collected waste bundle is relatively small compared to the total volume of the bins 20 and 28, and hence the loading of the bins 20 and 28 may be readily accomplished by hand. Further, because two types of waste material may be loaded at once, the loading time is not appreciably longer than that which would be required for commingled recyclable and non-recyclable material.

Optionally, a third type of waste having lower volume than either the waste type of the rear bin 20 or of the side bin 28 may be collected in a nose bin 36 which is attached to the vehicle 10 in front of the driver compartment 14. This nose bin 36 does not pivot and dump and is intended for small amounts of specialty recyclable waste such as newspapers that are readily managed by hand or that justify additional manual effort.

The extension and retraction of the hydraulic cylinders 24 and 34 moving bins 20 and 28 are controlled by valves 38 (not shown) and 39. Valve 38 is positioned near the hinge support 18 on the traffic side of the vehicle 10. Valve 39 is located on the rear bed 12 between the driver compartment 14 and the hinge support 32 on the curb side of the vehicle 10. The placement of valves 38 and 39 not only reduces the possibility that the operator of the vehicle 10 will be in the way of traffic when dumping the bins 20 and 28, but also serves to improve the efficiency of the unloading process as will be described below.

Figure 1:
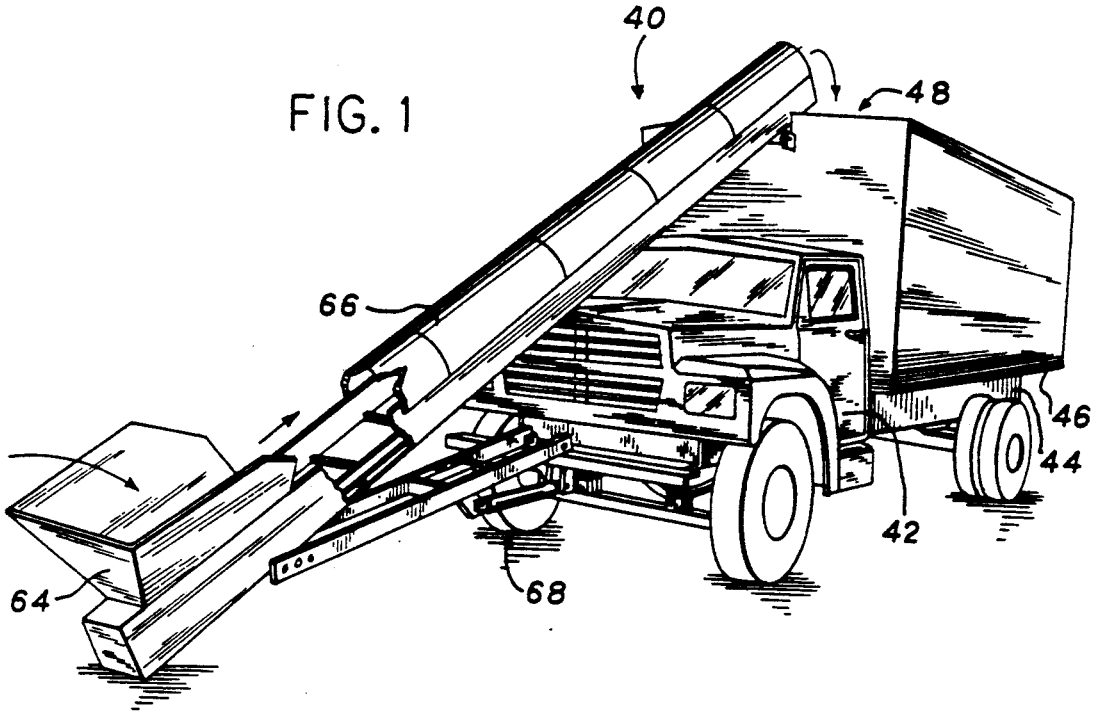
FIG. 1 is a perspective front view of a central collection vehicle showing the forward loading conveyor.

Referring to FIG. 1, a central collection truck 40 includes a cab 42 and bed 44, as is generally understood in the art, for travel generally along a longitudinal axis. A box-like container 46 is supported by the bed 44 to receive the segregated wastes from the satellite waste collection vehicle 10. Referring to FIG. 6, the rear of the container 46 pivots, in the manner of the container of a dump truck on a hinge 52 at the rear of the bed 44, and may be raised about that hinge 52 by a hydraulic cylinder 54 between a collecting position and a dumping position as will be described.

When the container 46 is in the collecting position, the bottom of the container 46 rests against the bed 44 and a partition 52 divides the container 46 into a front section 48 and a rear section 50, the partition 52 hanging vertically from a hinge 56 from the top of the container 46. It will be appreciated that the relative size of the front section 48 and the rear section 50 may be adjusted by relocating the position of the partition 52, and that the volumes of those sections 48 and 50 may be adjusted to correspond with the relative volumes of waste types to be received by these sections.

A lock 60 at the lowermost edge of the partition 52 locks the partition 52 against motion about hinge 56 by securing the lower edge of the partition 52 to the bottom wall of the container 46. The rear wall of the container 46 is a door 58 which, like partition 52, hangs vertically from a hinge from the top rear edge of the container 46.

The front section 48 of the container 46 is loaded by means of a conveyer 62 having a hopper 64 at one end for receiving waste and a belt section 66 for carrying the waste type from the hopper 64 to the other end of the conveyor 62, as is generally understood in the art. In a loading position, the hopper 64, as shown in solid lines in FIG. 6, is positioned near the ground in front of the cab 42 for receiving waste from the side bin 28 of the satellite vehicle 10 (not shown in FIG. 6). The belt section 66 rises above the cab 42 of the truck 40 and the end of the conveyor 66 removed from the hopper 64 is positioned at the top of the container 46 over the front section 48 to drop the waste into the front section 48. For long distance movement of the truck 40, the conveyor 62 is lifted to a transportation position (shown in phantom in FIG. 6) by means of a hydraulic cylinder and lever 68 having one end attached to the front lower edge of cab 42 and the other end attached to the hopper 64 to lift the hopper 64 and to slide the entire conveyor 62 backwards until the belt section 66 is generally parallel to the ground above the cab 42 and container 48. At all times during the movement of the conveyer 62 between its loading and transportation positions, the end of the conveyor 62 removed from the hopper 64 is over the front section 48. Accordingly, the conveyer 62 may be moved between its two positions even while waste is being moved through the belt section 66 without waiting or concern for spilling or misdirecting waste. A commercially available conveyor suitable for use with the present invention is manufactured by Jakel Co. Inc., of Reeseville, Wis. under the name of Shovelveyor.

Referring to FIGS. 4 and 5, the front section 48 of the container 46 is covered by a top wall 70 having a slotted opening 71 centered over the longitudinal axis of the truck 40 to provide an opening for receiving waste from the conveyor 62 in any position of the conveyer but reducing the possible loss of the waste caused by wind or the like.

Referring again to FIG. 6, the rear section 50 of the container 46 may be loaded by means of a rear lift 74 mounted on the back surface of the rear door 58. Referring to FIG. 3, the rear lift 74 employs a carrier plate 76 attached to a trolley 77 which rides between tracks 78 attached to the rear door 58. The corder plate 76 is lifted along tracks 78, from the bottom to the top of the container 46 by a reeving cylinder 80. A cart 82 (shown in FIG. 6) may be hung on the carrier plate 76 to receive waste from the satellite vehicle 10 and to lift the waste and dump the waste into the rear section 50.

Referring still to FIG. 3, the top edge of the carrier plate 76 is pivotably mounted on the trolley 77 so that when the carrier plate 76 is at the top edge of the container 46, a tipping cylinder (not shown) will cause the carrier plate 76 to tip upward and outward from the trolley 77 and the rear door 58 of the container 48 and to dump the contents of the cart 82 into the rear section 50 over the top of the container 46. An assembly for holding and tipping a cart 82 or the like and suitable for the present invention is commercially available from D&B Fluid Inc., Hutchinson, Kans. as model DBB500.

Wings 84, attached to the trolley 77 and extending outward toward the left and right side of the truck 40 are attached at their outer ends to upwardly extending levers 86 which engage a swinging lid 88 placed over the rear section 50. When the trolley 77 rises with a load of waste, the levers 86 are pushed upward by the wings 84 and serve to open the swinging lid 88 over the rear section 50 to permit the waste to be dropped into that section 50 and yet to prevent the escape of waste during other times.

Referring to FIG. 7, the container 46 may be emptied rapidly, yet still preserving the segregation of the waste in the front and rear sections 48 and 50, by tipping the container 46 upward on hinge 52 so that the bottom of container 46 is slopped downward toward the rear of the truck 40 and the force of gravity acts to pull the waste in the front and rear sections 48 and 50 toward the rear door 58. The rear door 58 swings open to permit the rear section 50 to be emptied through the rear door 58, but the partition 52 is kept locked by lock 60 to prevent the front section 48 from being emptied. Once the rear section 50 is emptied, the truck 40 may be repositioned and the partition 52 released to empty the front section 48.

Figure 8:
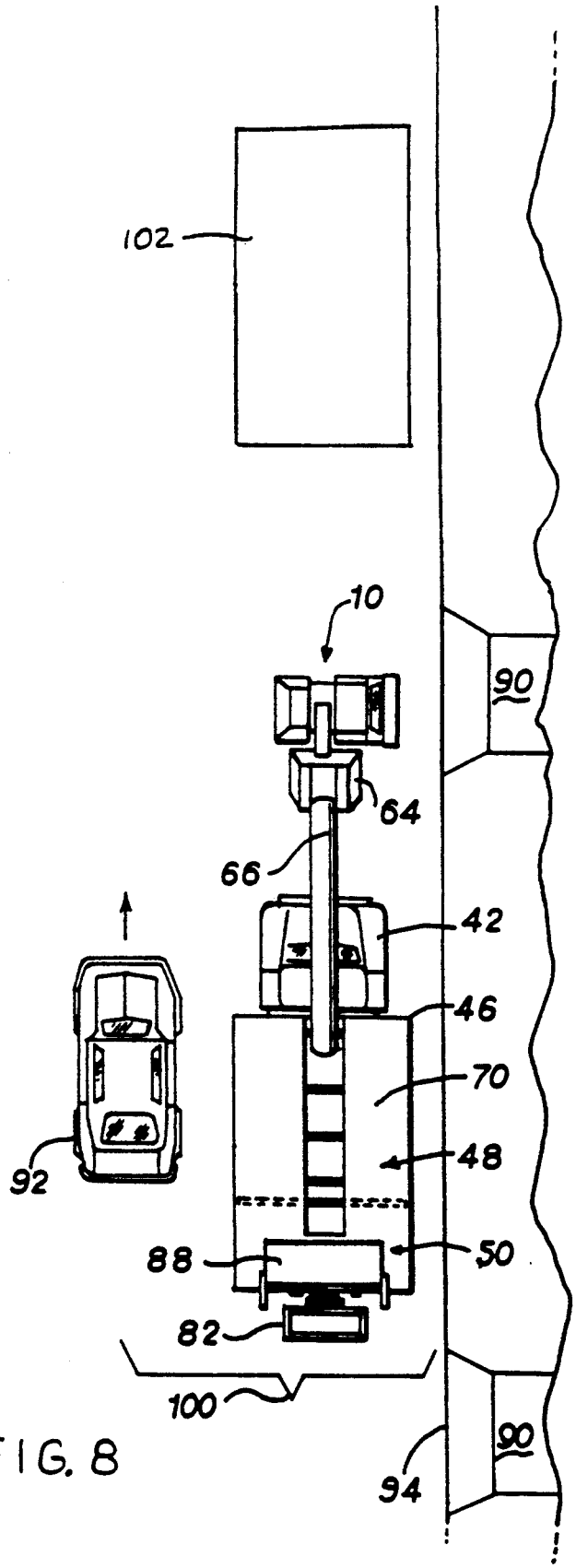
FIG. 8 is a plan view similar to FIG. 5 showing the placement of a conventional garbage truck in addition to the plan shown in FIG. 5.

Referring to FIGS. 4 and 5, the satellite vehicle 10 unloads its bins of segregated waste 20 and 28 to the collection truck 40 and a conventional compacting garbage truck 102 (see FIG. 8) positioned between alleys or side streets 90 positioned on a main street 100 by traveling generally with traffic 92 but next to the curb 94 to position its nose bin 36 near the cart 82 for unloading.

The satellite vehicle 10 then travels to the front of the collection truck 40, still with the flow of traffic 92 and turns toward the curb 94 in front of the collection truck 40 to dump its side bin 28 into the hopper 64. Either before or after unloading to the collection truck 40, the satellite vehicle 10 may back up to the rear of the conventional garbage truck for unloading non-recyclable waste from its rear bin 20. During all unloading operations, the satellite collection vehicle 10 is out of the line of oncoming traffic 92.

Many modifications and variations of the preferred embodiment which will still be within the spirit and scope of the invention will be apparent to those with ordinary skill in the art. For example, means other than the conveyor lift may be used for loading the front section and rear sections of the box. In order to apprise the public of the various embodiments that may fall within the scope of the invention, the following claims are made.

We claim:

1. A recyclable waste collection apparatus comprising:

a motorized truck with a longitudinal axis having a cab for a driver and a bed;

a partitioned container attached to the truck bed having a first volume and a second volume separated from the first volume;

a first waste receiving means communicating with the first volume and having a first opening sized to receive a first waste type into the first volume;

a second waste receiving means communicating with the second volume and having a second opening for receiving a second waste type into the second volume;

a motorized satellite vehicle having a passenger compartment for holding at least one occupant and having a supporting bed;

a first bin on the satellite vehicle having a smaller volume than the first volume of the partitioned container attached to the truck bed for carrying the first waste type to the first volume, the first bin having an opening and being pivotally mounted n the supporting bed of the satellite vehicle so that the first bin can be moved from a first collection position to a first rearwardly moveable dumping position;

a first actuator for moving the first bin from the first collection position to the first rearwardly movable dumping position so that the first waste type can be dumped from the first bin of the satellite vehicle into the first opening of the truck;

a second bin on the satellite vehicle having a smaller volume than the second volume of the partitioned container attached to the truck bed for carrying the second waste to the second volume, the second bin having an opening and being pivotally mounted on the supporting bed of the satellite vehicle so that the second bin can be moved from a second collection position to a second sidewardly movable dumping position; and a second actuator for moving the second bin from the second collection position to the second sidewardly movable dumping position so that the second waste type can be dumped from the second bin of the satellite vehicle into the second opening of the truck.

2. A recyclable waste collection apparatus as recited in claim 1 wherein the first and second bins on the motorized satellite vehicle are rearward from the passenger compartment, and the satellite vehicle further includes a third bin mounted on the supporting bed of the satellite vehicle forward from the passenger compartment.

3. A recyclable waste collection apparatus as recited in claim 1 wherein the first waste receiving means on the motorized truck opens rearward from the truck, and the second waste receiving means on the motorized truck opens in front of the truck.

4. A recyclable waste collection apparatus as recited in claim 1 wherein the partitioned container attached to the motorized truck bed is pivotally mounted on the truck bed about a pivot axis which is substantially perpendicular to the longitudinal axis of the motorized truck so a truck actuator can dump the first and second waste types rearward from the truck.

5. A recyclable waste collection apparatus as recited in claim 1 wherein the second waste receiving means on the motorized truck can carry waste over the cab of the truck to the first volume.

6. A system for collecting and transporting mixed trash and recyclable waste separated from the mixed trash from several pick up locations to final delivery destinations, the system comprising:

a garbage truck having a mixed trash container for collecting mixed trash and a mixed trash receiving means for receiving mixed trash and moving the mixed trash into the mixed trash container;

a motorized recyclable waste collection truck with a longitudinal axis, the recyclable waste collection truck having a cab for a driver, a recyclable waste container for collecting recyclable waste, and a recyclable waste receiving means for receiving recyclable waste and moving the recyclable waste into the recyclable waste container;

a motorized satellite vehicle having a passenger compartment for holding at least one occupant and having a supporting bed;

a mixed trash bin on the satellite vehicle having a smaller volume than the mixed trash container on the garbage truck for carrying mixed trash from the pick up location to the mixed trash container on the garbage truck, the mixed trash bin having an opening and being pivotally mounted on the supporting bed of the satellite vehicle so that the mixed trash bin can be moved from a collection position to a rearwardly movable dumping position;

an actuator for moving the mixed trash bin from the collection position to the rearwardly movable dumping position so that mixed trash can be dumped from the mixed trash bin of the satellite vehicle into the mixed trash receiving means of the garbage truck;

a recyclable waste bin on the satellite vehicle having a smaller volume than the recyclable waste container on the recyclable waste collection truck for carrying recyclable waste from the pick up location to the recyclable waste container on the recyclable waste collection truck, the recyclable waste bin having an opening and being pivotally mounted on the supporting bed of the satellite vehicle so that the recyclable waste bin can be moved from a collection position to a sidewardly movable dumping position; and an actuator for moving the recyclable waste bin from the collection position to the sidewardly movable dumping position so that recyclable waste can be dumped from the recyclable waste bin of the satellite vehicle into the recyclable waste receiving means of the recyclable waste collection truck;

wherein the mixed trash and the recyclable waste can be transported to independent delivery destinations by driving the garbage truck to a delivery destination for the mixed trash and driving the recyclable waste to a delivery destination for the recyclable waste.

7. A system as recited in claim 6 wherein the mixed trash bin and the recyclable waste bin on the motorized satellite vehicle are rearward from the passenger compartment, and the satellite vehicle also includes an additional recyclable waste bin mounted on the supporting bed of the satellite vehicle forward from the passenger compartment; and wherein the motorized recyclable waste collection truck has an additional recyclable waste container for collecting additional recyclable waste, and an additional recyclable waste receiving means for receiving additional recyclable waste and moving the additional recyclable waste into the additional recyclable waste container.

8. A system as recited in claim 6 wherein the recyclable waste receiving means on the motorized recyclable waste collection truck can carry waste over the cab of the truck into the recyclable waste container.

* * * * *